US009315369B2

(12) United States Patent
Wang

(10) Patent No.: US 9,315,369 B2
(45) Date of Patent: Apr. 19, 2016

(54) HAND TOOL

(75) Inventor: Weiyi Wang, Zhejiang Province (CN)

(73) Assignee: Hangzhou Great Star Tools Co., Ltd., Hangzhou, Zhejiang Province (CN)

( * ) Notice: Subject to any disclaimer, the term of this patent is extended or adjusted under 35 U.S.C. 154(b) by 75 days.

(21) Appl. No.: 13/582,008

(22) PCT Filed: Nov. 25, 2011

(86) PCT No.: PCT/CN2011/082987

§ 371 (c)(1),
(2), (4) Date: Nov. 12, 2012

(87) PCT Pub. No.: WO2012/069018

PCT Pub. Date: May 31, 2012

(65) Prior Publication Data

US 2013/0227794 A1 Sep. 5, 2013

(30) Foreign Application Priority Data

Nov. 25, 2010 (CN) ..... 2010 2 0625839 U

(51) Int. Cl.

| | |
|---|---|
| ***B67B 7/44*** | (2006.01) |
| ***B67B 7/20*** | (2006.01) |
| ***B25F 1/04*** | (2006.01) |
| ***B26B 1/04*** | (2006.01) |
| ***B26B 11/00*** | (2006.01) |
| ***B25F 1/00*** | (2006.01) |

(52) U.S. Cl.

CPC . *B67B 7/44* (2013.01); *B25F 1/006* (2013.01); *B25F 1/04* (2013.01); *B26B 1/044* (2013.01); *B26B 11/001* (2013.01); *B26B 11/006* (2013.01); *B67B 7/20* (2013.01)

(58) Field of Classification Search

CPC ..... B25F 1/04; B25F 1/006; B26B 11/001; B26B 11/006; B26B 11/044; B67B 7/44; B67B 7/20

USPC ..... 7/118, 105, 151, 152, 156, 158; 81/3.55

See application file for complete search history.

(56) References Cited

U.S. PATENT DOCUMENTS

| | | | | |
|---|---|---|---|---|
| 1,204,676 | A * | 11/1916 | Machuga | 7/118 |
| 1,264,430 | A * | 4/1918 | Ossman | 7/105 |
| 1,635,649 | A * | 7/1927 | Tillmanns | 7/118 |
| 2,332,656 | A * | 10/1943 | Mirando | 7/118 |
| 2,980,996 | A * | 4/1961 | Beran | 7/118 |
| 4,607,407 | A * | 8/1986 | Bergmeister | 7/156 |
| 5,220,701 | A * | 6/1993 | Creato et al. | 7/105 |
| 6,427,274 | B1 * | 8/2002 | Abbott | 7/105 |
| 6,915,577 | B2 * | 7/2005 | Scala | B26B 1/044 30/156 |
| 6,948,409 | B2 * | 9/2005 | Ackeret et al. | 7/118 |
| 7,437,822 | B2 * | 10/2008 | Flagg et al. | 7/118 |
| 2009/0025513 | A1 * | 1/2009 | Salvino | 7/151 |

FOREIGN PATENT DOCUMENTS

| | | |
|---|---|---|
| CN | 2756265 | 2/2006 |
| CN | 2848265 | 12/2006 |

(Continued)

*Primary Examiner* — Hadi Shakeri

(74) *Attorney, Agent, or Firm* — Boyle Fredrickson, S.C.

(57) ABSTRACT

A hand tool including a handle with a containing chamber, and a can opener that can be rotatably received in the containing chamber or unfolded connected pivotally to an end of the handle, and the can opener is made of metal material and used to open a paint can lid.

7 Claims, 8 Drawing Sheets

(56) References Cited

FOREIGN PATENT DOCUMENTS

| | | |
|---|---|---|
| CN | 201091752 | 7/2008 |
| CN | 101244320 | 8/2008 |
| CN | 102218201 | 10/2011 |
| CN | 202185094 | 4/2012 |

* cited by examiner (a)

(b)

(c)

HAND TOOL

FIELD OF THE INVENTION

The present invention relates to the field of hand tool and more particularly, to a hand tool.

DESCRIPTION OF THE PRIOR ART

Multiple operations are required in some certain working circumstances, which causes workers to carry various tools, for example, causes a painting worker to carry a cutting knife, a putty knife, a paint can opener and the like simultaneously, according to the prior hand tool, for the reason that knife tools may be utilized while paint may also need to be opened on site. These tools are inconvenient to carry and also prone to missing and losing, which may bring trouble to the work. The cutting knife in prior art used to have a blade installed on the handle to realize the single function of cutting, and cutting knives of various structural styles, such as a cutting knife with a replaceable blade and the like, have been on the market nowadays as operation requirements enhance. And the can openers in prior art are usually integrally formed by plastic injection molding and are of large size, besides, the portions of the can openers, which are used to open the can, tend to hook other objects while may bring other objects out when moved and cause damage to other objects as well.

Accordingly, it is an object of the present invention to provide a hand tool which has the said multiple functions and is convenient to carry and use.

SUMMARY OF THE INVENTION

The present invention provides a hand tool including a handle with a containing chamber, and a can opener that can be rotatably received in the containing chamber or unfolded connected pivotally to an end of the handle, and the can opener is made of metal material and used to open a paint can lid.

In a preferred embodiment of the present invention, a putty knife that can be rotatably received in the containing chamber or unfolded is also pivotally connected to one end of the handle.

In a further preferred embodiment thereof, a blade carrier on which mounted a replaceable blade, can be rotatably received in the containing chamber or unfolded, is also pivotally connected to one end of the handle.

In another preferred embodiment of the present invention, an elastic part with lateral elastic lateral elastic force which is disposed in the containing chamber of the handle, and at least one of the blade carrier, the can opener and the putty knife has a positioning part at the pivoting connection end thereof, and the side of the elastic part engages against the side of the pivoting connection end by the lateral elasticity when folded, while the elastic part deflects and forms a locking fit with the positioning part when unfolded. In a further embodiment thereof, the positioning part is a platform formed at the end of the pivoting end, and the locking fit is formed by engaging the straight edge of the end part of the elastic part against the platform.

In another preferred embodiment of the present invention, the elastic part is an elastic piece formed by slotting partially on the spacer fixed in the containing chamber. And in a further embodiment thereof, the elastic piece is formed at one or both edges of one or both ends of the spacer.

In another preferred embodiment of the present invention, the side of the elastic part, which contacts at least one of the blade carrier, the can opener and the putty knife, has a point-shaped protrusion, and the protrusion is as such arranged that when at least one of the blade carrier, the can opener and the putty knife is received in the containing chamber, the point-shaped protrusion slides into the corresponding groove arranged on the containing chamber.

In another preferred embodiment of the present invention, the pivoting connection is connected to the handle through a pivot.

In another preferred embodiment of the present invention, the can opener is a plate-shaped member with a jaw in the middle thereof and a hook-shaped part extending inwards from each edge of the jaw. In another preferred embodiment of the present invention, a shovel-shaped part extending forward is arranged at the front of the can opener.

In another preferred embodiment of the present invention, a through hole and/or a groove is arranged on the body of the putty knife.

In another preferred embodiment of the present invention, a removable protective casing is arranged over the replaceable blade, and a lug extending laterally from the adjacent side wall of the spacer or the handle near the front of the tip of the replaceable blade in the containing chamber is used to prevent the protective casing from detaching from the blade.

In present invention, the paint can opener is usually made of stronger metal material in stead of the plastics in prior art, so that the hook-shaped part and/or shovel-shaped part thereof with opening function can be designed and made smaller and sharper so as to be located more precisely and quickly when opening the can; however, if such sharp metal product is exposed outside, 1) it may hurt the hands of the user who fetch the paint can, 2) it tends to hook other objects, and 3) it may damage and/or do harm to other objects, thus, it is very necessary to design the metal-made can opener to be a tool which can be received in a folding style. Designed to be a foldable one, the tool is convenient to carry and use. Meanwhile, tools such as putty knives, cutting knives and the like which are required in painting work can be collected in a single hand tool so as to allow the user to select to meet the different operation requirements in use easily and to reduce the possibility of losing.

Hereinafter more detailed description will be made by incorporating figures to illustrate the conception, structure and technical effect of the present invention for a better understanding of the object, features and effects of the present invention.

DETAILED DESCRIPTION OF THE PREFERRED EMBODIMENTS

The 'tool' referred in the application includes all kinds of apparatus that can be used in hand tool forms, such as blades, can openers, putty knives, screws, scissors, pincers and the like. And the 'hand tool' referred in the application comprises at least one of the tools mentioned above.

Figure 1:
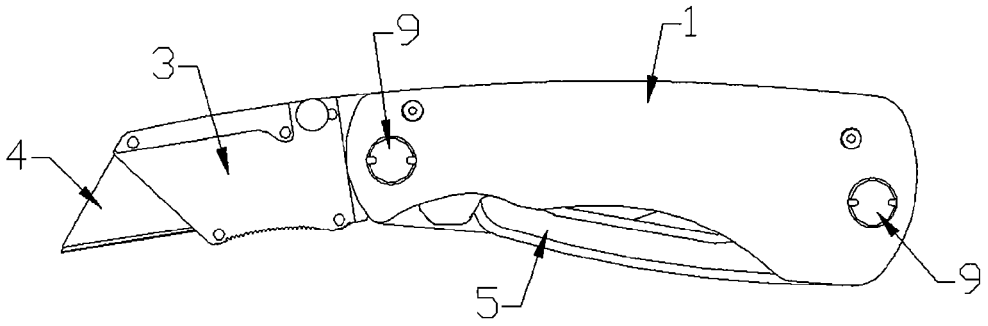
FIG. 1 is a schematic view of an embodiment according to the present invention showing the hand tool with the blade carrier unfolded, and the putty knife and the can opener folded.
Figure 4:
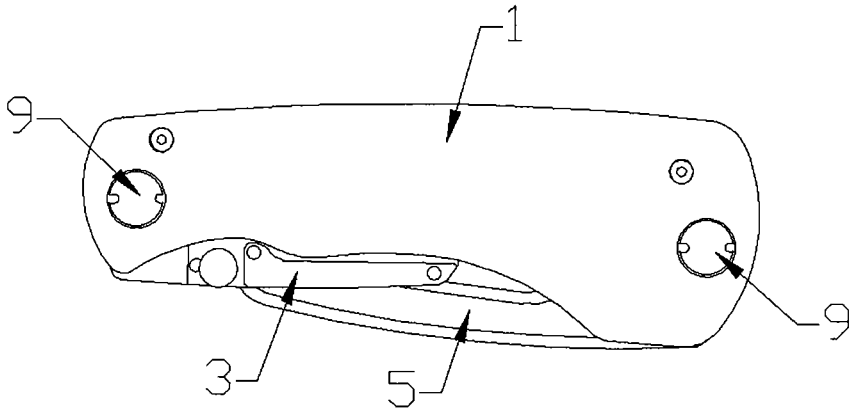
FIG. 4 is a schematic view of an embodiment according to the present invention showing the hand tool with the can opener, the blade carrier and the putty knife all folded.
Figure 5:
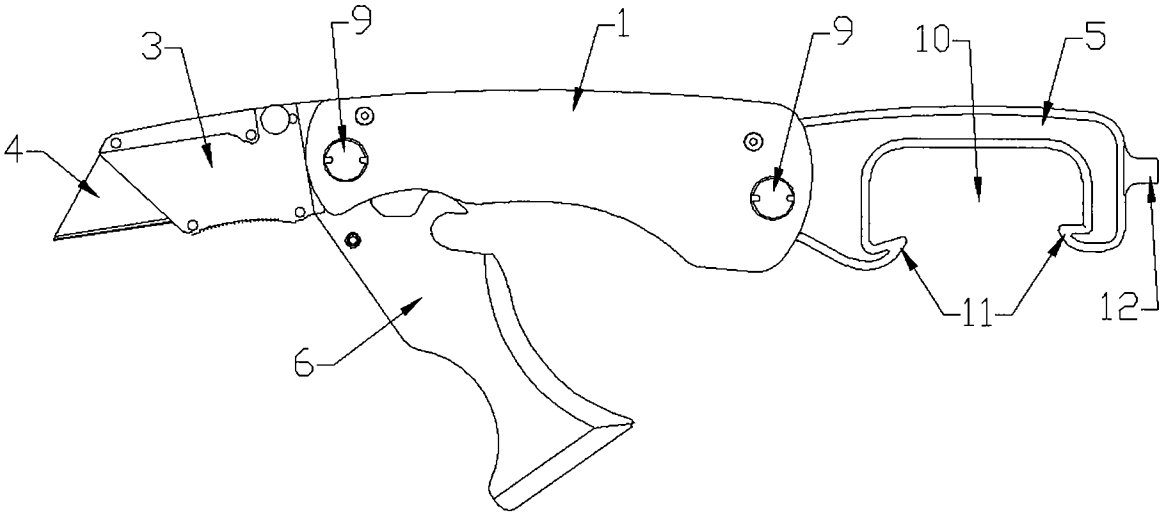
FIG. 5 is a schematic view of an embodiment according to the present invention showing the hand tool with the can opener and the blade carrier unfolded, and the putty knife semi-folded.
Figure 6:
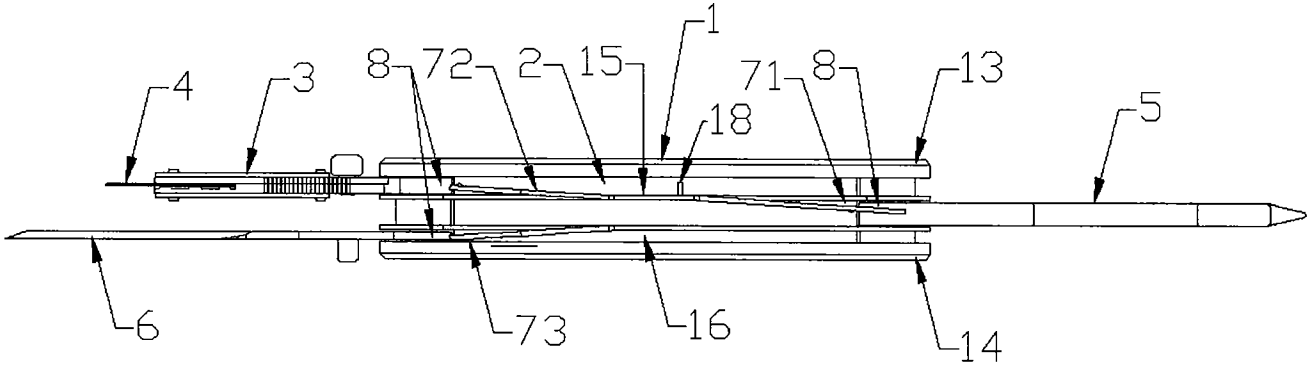
FIG. 6 is a bottom view of FIG. 5.
Figure 7:
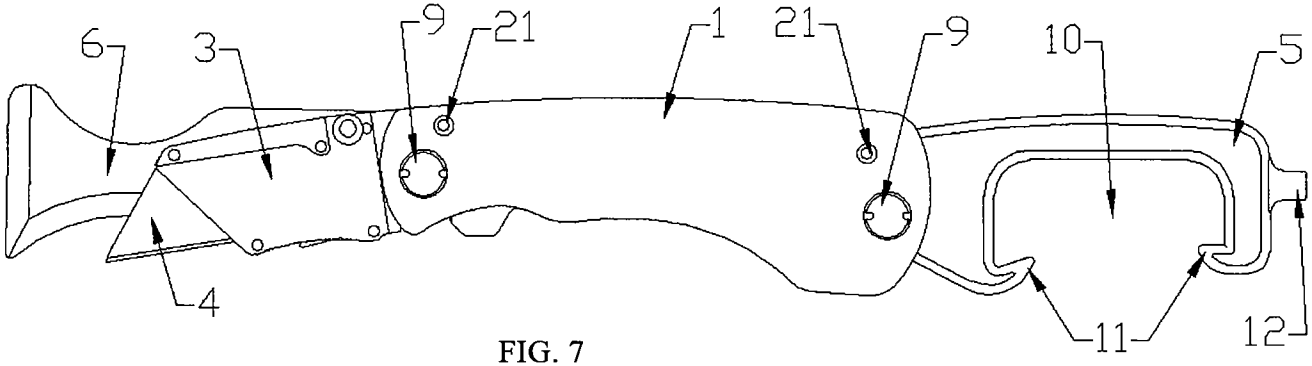
FIG. 7 is a schematic view of an embodiment according to the present invention showing the hand tool with the can opener, the blade carrier and the putty knife all unfolded.
Figure 8:
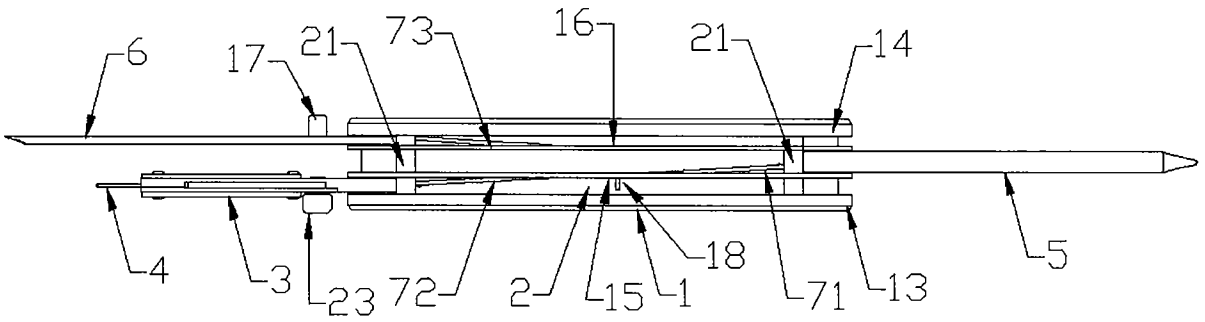
FIG. 8 is a top view of FIG. 7.

FIG. 1-9 show a preferred embodiment of the hand tool according to the present invention. As seen in FIG. 6 and FIG. 8, the handle 1 of the embodiment is composed of two sidewalls 13, 14, and the sidewalls 13, 14 are fixedly connected and spaced from each other by pivot 9 that are at both sides of the sidewalls as shown in FIG. 1 to form a containing chamber 2 therebetween. Spacers 15, 16 which are substantially parallel to the sidewalls 13, 14 are arranged in the containing chamber 2, and the both ends of which are fixed on the pivot 9, respectively. A can opener 5 is arranged at the first end of the handle 1, and can rotate about the pivot 9 in a first pivoting direction between the open position and the close position, so that when the can opener 5 reaches the close position, it can be received in the containing chamber 2 between the spacers 15, 16. A blade carrier 3 and a putty knife 6 are arranged at the second end of the handle 1, and can rotate in a second pivoting direction between the open position and close position. When the blade carrier 3 on which mounted a replaceable blade 4 reaches its close position, it can be received in the containing chamber 2 between the sidewall 13 and the spacer 15, while when the putty knife 6 reaches its close position, it can be received in the containing chamber 2 between the sidewall 14 and the spacer 16. In other embodiments, the handle 1 also can be integrally formed with an opening at only one side, so the tools in the containing chamber 2 can only be rotated out of the open side of the handle 1 and unfolded. As shown in FIG. 7 and FIG. 8, a stop pin 21 parallel to the pivot 9 is arranged at each end of the handle 1, and when the tools mentioned above are unfolded to the open position, the tail of the tools may be restricted by the stop pin 21, so that the tool may stop rotating in the original pivoting direction.

Figure 12:
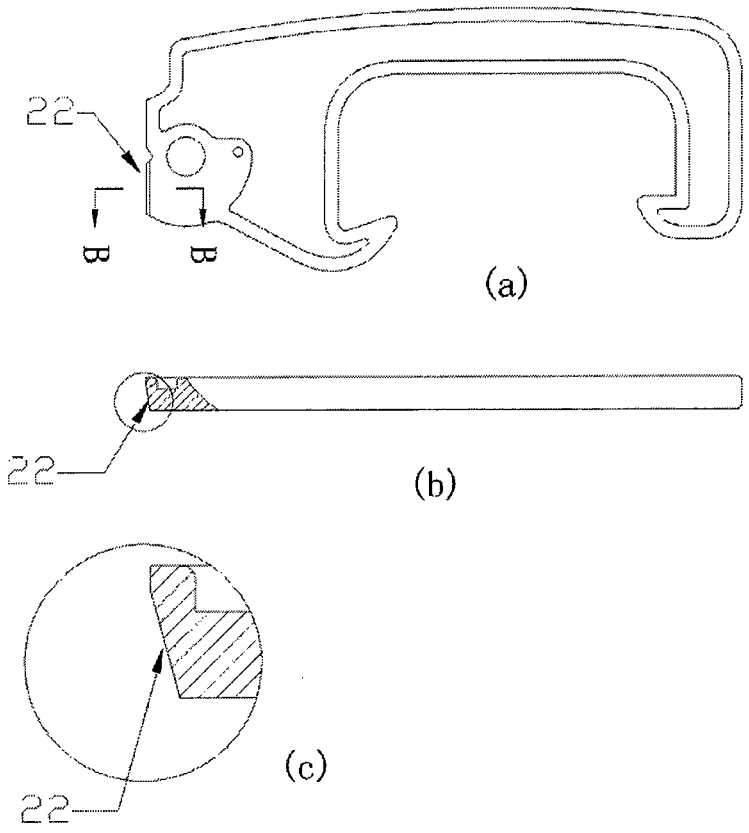
FIG. 12 is an embodiment of the can opener according to the present invention, wherein (a) is a front view of the can opener, (b) is a top view of the can opener wherein the dashed area is a cross-sectional view of (a) along direction B-B, (c) is a partially enlarged view of the dashed area in (b)

As seen in FIG. 6 and FIG. 8, elastic part 71, 72 are arranged in the direction of the first end and second end of the handle 1 by the spacer 15. In this embodiment, the locating elastic part 71, 72 are elastic pieces formed by partially split from the spacer 15 at both ends thereof and have lateral elasticity, FIG. 10. The elastic part 71 is arranged to be elastically deflecting to the can opener 5, and when the can opener 5 is in its close position, the side of the elastic part 71 contacts the side of the can opener 5 and applies a certain lateral pressure to the latter with the effect of elastic deflecting force, which restricts the can opener 5 not to rotate out of its close position in the containing chamber 2 easily. While the can opener 5 pivots to its open position from its close position, the side of the elastic part 71 detaches from the side of the can opener 5, and then the elastic part 71 deflects with the effect of elasticity to form a lock-fit with the positioning part 8 of the can opener 5. In this embodiment, the lock-fit is realized by engaging the straight edge of the end of the elastic part 71 against the platform 22 which is arranged at the tail of the can opener 5 and can be pivotally connected to the pivot 9, FIG. 12. As shown in FIG. 12, the platform 22 has a certain ascending slope in the deflecting direction of the elastic part 71 fitting the former, so that the deflected elastic part 71 can form a tight fit automatically with the platform 22, but if the ascending slope is too sharp, the stressed elastic part 71 may deflect and slide on the platform 22, which may do harm to the locking effect. This lock-fit, together with the stop pin 21, lock the opener 5 in its close position and prevent the opener 5 from rotating about the pivot 9, which affords a safer and more reliable use. When the can opener 5 is to be folded, a force whose direction is opposite that of the elastic deflection should be applied to the elastic part 71 to replace the latter to its original position before deflecting, so as to detach the elastic part 71 from its lock-fit position, and then the can opener 5 can rotate back into the containing chamber 2.

As seen in FIG. 6 and FIG. 8, the elastic part 72 is arranged to be elastic deflecting to the blade carrier 3, similarly, when the blade carrier 3 is in its close position, the side of the elastic part 72 contacts the side of the blade carrier 3 and applies a certain lateral pressure to the latter with the effect of elastic deflecting force, which restricts the blade carrier 3 not to rotate out of its close position in the containing chamber 2 easily. While the blade carrier 3 pivots to its open position from its close position, the side of the elastic part 72 detaches from the side of the blade carrier 3, and then the elastic part 72 deflects with the effect of elasticity to form a lock-fit with the positioning part 8 of the blade carrier 3. In this embodiment, the locking fit is realized by engaging the straight edge of the end part of the elastic part 72 against the platform arranged at the tail of the blade carrier 3 and pivotally connected to the pivot 9. Similar to that in FIG. 12, the platform has a certain ascending slope in the deflecting direction of the elastic part 72 fitting the former, so that the deflected elastic part 72 can form a tight fit automatically with the platform, but if the ascending slope is too sharp, the stressed elastic part 72 may deflect and slide on the platform, which may do harm to the locking effect. This lock-fit, together with the stop pin 21, lock the blade carrier 3 in its open position and prevent the blade carrier 3 from rotating about the pivot 9, which affords a safer and more reliable use. When the blade carrier 3 is to be folded, a force whose direction is opposite that of the elastic deflection should be applied to the elastic part 72 to replace the latter to its original position before deflecting, so as to detach the elastic part 72 from its locking fit position, and then the blade carrier 3 can rotate back into the containing chamber 2.

As seen in FIG. 6 and FIG. 8, the spacer 16 is arranged in the direction of the second end of the handle 1 by the spacer 16. In this embodiment, the elastic part 73 is also formed by partially split longitudinally from the spacer 16 and arranged to be elastic deflecting to the putty knife 6. Similarly, when the putty knife 6 is in its close position, the side of the elastic part 73 contacts the side of the putty knife 6 and applies a certain lateral pressure to the latter with the effect of elastic deflecting force, which restricts the putty knife 6 not to rotate out of its close position in the containing chamber 2 easily. While the putty knife 6 pivots to its open position from its close position, the side of the elastic part 73 detaches from the side of the putty knife 6, and then the elastic part 73 deflects with the effect of elasticity to form a lock-fit with the positioning part 8 of the putty knife 6. In this embodiment, the locking fit is realized by engaging the straight edge of the end of the elastic part 73 against the platform arranged at the tail of the putty knife 6 and pivotally connected to the pivot 9. Similar to that in FIG. 12, the platform has a certain ascending slope in the deflecting direction of the elastic part 73 fitting the former, so that the deflected elastic part 73 can form a tight fit automatically with the platform, but if the ascending slope is too sharp, the stressed elastic part 73 may deflect and slide on the platform, which may do harm to the locking effect. This lock-fit, together with the stop pin 21, lock the putty knife 6 in its open position and prevent the putty knife 6 from rotating about the pivot 9, which affords a safer and more reliable use. When the putty knife 6 is to be folded, a force whose direction is opposite that of the elastic deflection should be applied to the elastic part 73 to replace the latter to its original position before deflecting, so as to detach the elastic part 73 from its locking fit position, and then the putty knife 6 can rotate back into the containing chamber 2.

As mentioned above, in this embodiment, the spacer 15 has two elastic parts 71 and 72 with opposite orientations and opposite deflecting directions, while the spacer 16 has only one elastic part 73, however, the spacers above have same effect and function such as, when the tool like the can opener, the blade carrier or the putty knife is in its close position, the side of the elastic part of the spacer applies a certain lateral pressure to the side of the tool with the effect of elastic deflecting force, which restricts the tool not to leave the containing chamber, while when the tool is in its open position, the side of the elastic part detaches from the side of the tool, and then the elastic part deflects with the effect of elasticity to form a locking fit between the end edge of the elastic part and tail of the tool so as to lock the tool. Therefore, according to the number and the different open orientations of the tools, a plurality of spacers can be arranged in the containing chamber and the spacers can have a plurality of elastic parts that can deflect toward the first lateral direction or the second lateral direction. In other embodiments, for example, the spacer also can have two elastic parts whose deflecting direction are the same or different at one end thereof, or a plurality of elastic parts whose deflecting direction are the same at different ends thereof, or have other various forms of elastic parts.

Figure 10:
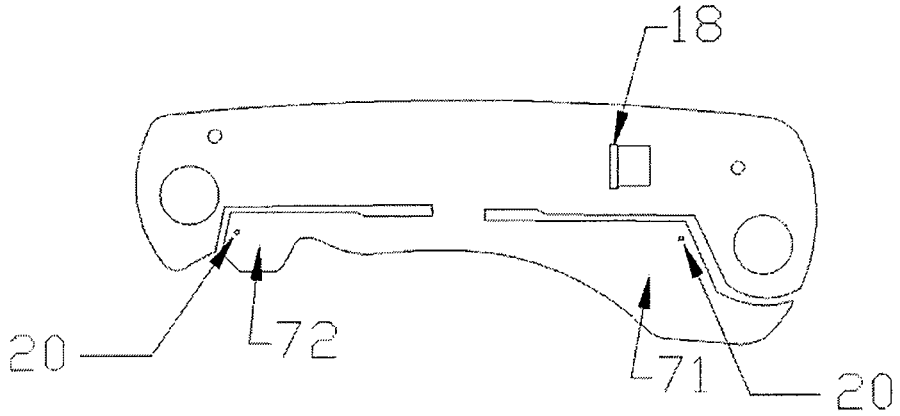
FIG. 10 is a front view of an embodiment according to the present invention showing a spacer in the handle of the hand tool.

Further, as seen in FIG. 10, a point-shaped protrusion can also be arranged on the side of the elastic part, contacting the tool, and a corresponding groove (not shown) can be arranged on the side of the tool, contacting the elastic part. When the user presses the elastic part back and folds the tool, the side of the tool may contact the side of the elastic part firstly, and during the folding process, the side of the tool passes over the point-shaped protrusion 20 of the side of the elastic part and contacts the elastic part, meanwhile the elastic part applies a lateral pressure to the side of the tool through the point-shaped protrusion on the side thereof; as the tool enters its close position, the point-shaped protrusion 20 slides into the corresponding groove arranged on the side of the tool, so that the tool has an automatic self-closing action at the end of the folding process to further prevent the tool from rotating out of the containing chamber unexpectedly.

As shown in FIG. 5, in this embodiment, the can opener is a plate-shaped member with a jaw 10 in the middle, and the jaw 10 has a hook-shaped member 11 extending toward the inside of the jaw 10 on each edge. In a further embodiment, the can opener 5 has a shovel-shaped part 12 extending forward at the front, and the hook-shaped part and the shovel-shaped part can be used together or individually to satisfy the specific structure of the can lid to be opened. In a preferred embodiment, the can opener 5 is designed to be suitable for opening the paint can lid, and compared to the can opener for paint can formed by plastic injection molding in prior art, the can opener 5 is made of stronger materials such as tool steel, aluminum alloy or other metal materials, so that on the one hand the members arranged on the can opener 5 with the opening function, i.e., the hook-shaped part 11 and/or the shovel-shaped part 12, can be designed and manufactured smaller and shaper so as to be located more precisely and quickly, and on the other hand the bulk of the can opener 5 can be reduced while the can opener 5 still has sufficient strength, which allows the can opener 5 to be received in the handle of the hand tool according to the present invention, so as to be convenient to carry and to avoid trouble and possible damage and harm brought by sharp and naked member such as the hook-shaped part 11. Further, the can opener 5 and the tool that is often used in the same work such as the putty knife 6 can be assembled in the form of the hand tool according to the embodiment of the present invention to allow the user select easily to meet different operating requirements instead of looking for the different tools everywhere, which brings convenience and higher working efficiency. Also, the possibility of losing can be avoided, for multiple tools are assembled together.

Figure 13:
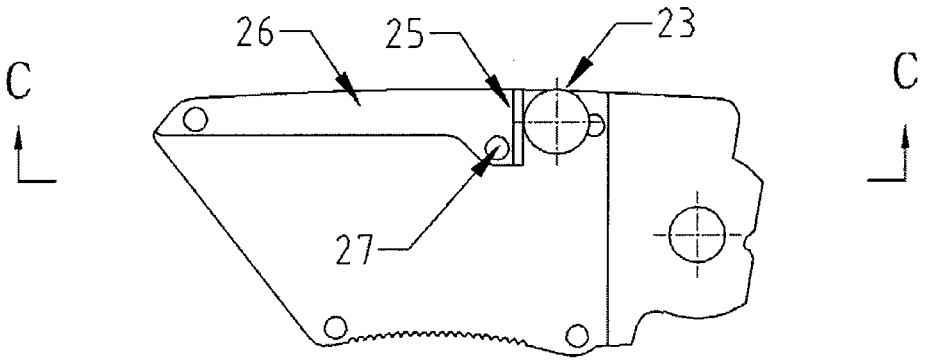
FIG. 13 is an embodiment of blade carrier according to the present invention, wherein (a) is a front view of the blade carrier, (b) is a cross-sectional view of (a) along direction C-C in (a), (c) is a front view of the locking member of the blade carrier.
Figure 13:
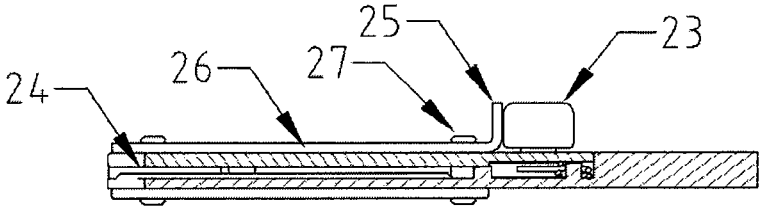
Figure 13:
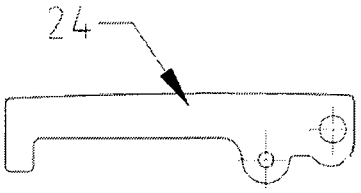

As shown in FIG. 13, in this embodiment, a groove is arranged on the replaceable blade 4, and a locking member 24 is arranged on the blade carrier 3. The locking member 24 can rotate partially by stirring the pin 23 arranged on the locking member 24 about the positioning pin 27 connected to the blade carrier 3, so as to locked in the groove of the blade 4 or to be held up to release the blade 4. In another embodiment, the pin 23 can also be replaced by a protrusion part integrally molded with the locking member 24. Further, a protrusion part 25 is arranged side by side with the pin 23 in the direction vertical to the stirring direction of the pin 23, to avoid the pin 23 being stirred unexpectedly in use. In this embodiment, the protrusion part 25 is formed by a wrapped end of the strip-shaped member 26 fixed on the blade carrier 3, though the protrusion part 25 can be integrally formed with the blade carrier 3. The blade 4 can also be locked in the blade carrier 3 in the way of prior art, and can be unlocked for replacement. The part of the blade 4, which is exposed out of the blade carrier, can be put into a removable protective casing made of plastic, so as to protect the blade not in use. Further, a pin 17 easy to screw out is arranged on the side of the putty knife 6. FIG. 8. In addition, in order to prevent the protective casing from detaching from the naked part of the blade 4 unexpectedly, a lug 18 extending laterally from the adjacent side wall of the spacer or the handle near the front of the tip of the blade in its close position can be arranged FIG. 6 and FIG. 8. In an embodiment, the lug 18 is formed by cutting and bending a part of the adjacent spacer, FIG. 10.

Figure 11:
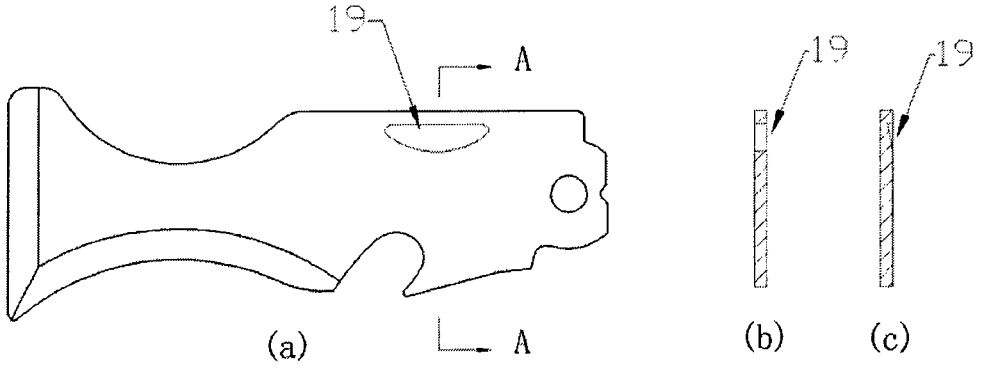
FIG. 11 is another embodiment of the putty knife of the hand tool according to the present invention, wherein (a) is a front view of the putty knife, (b) is a cross-sectional view along direction of A-A when a through hole is arranged on the body of the putty knife (c) is a cross-sectional view along direction A-A when a groove is arranged on the body of the putty knife.

As shown in FIG. 5, in this embodiment, the putty knife 6 as edging merely at its front and at the end rotating into the containing chamber 2, and has a hook-shaped part at the end rotating into the containing chamber 2 as well. A pin 17 easy to screw out is arranged on the body of the knife, FIG. 8. In another embodiment, as shown in FIG. 11, a through hole or groove 19 is arranged on the body of the putty knife 6 to allow the user to rotate the putty knife 6 out of the containing chamber 2. As the through hole or the groove 19 can be milled or punched out of the body of the putty knife 6, the process is simpler compared to the process of arranging the pin 17 on the knife body, so that the production cost can be lowered and incorrect operation can also be prevented.

Figure 2:
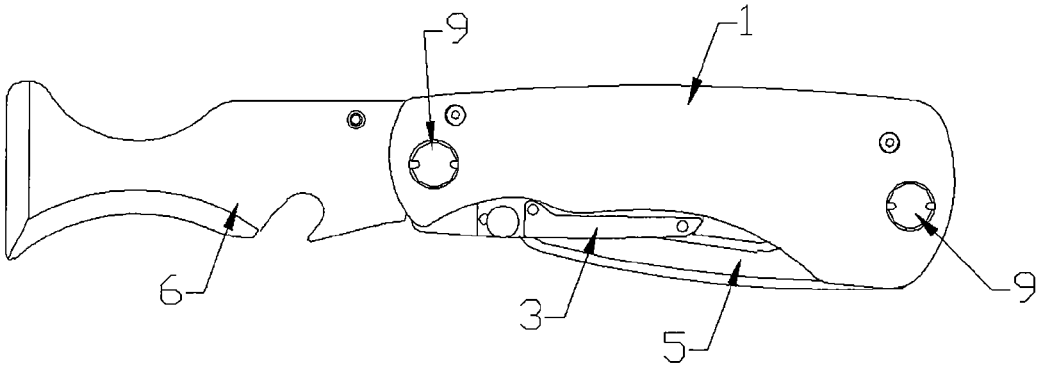
FIG. 2 is a schematic view of an embodiment according to the present invention showing the hand tool with the putty knife unfolded, and the blade carrier and the can opener folded.
Figure 3:
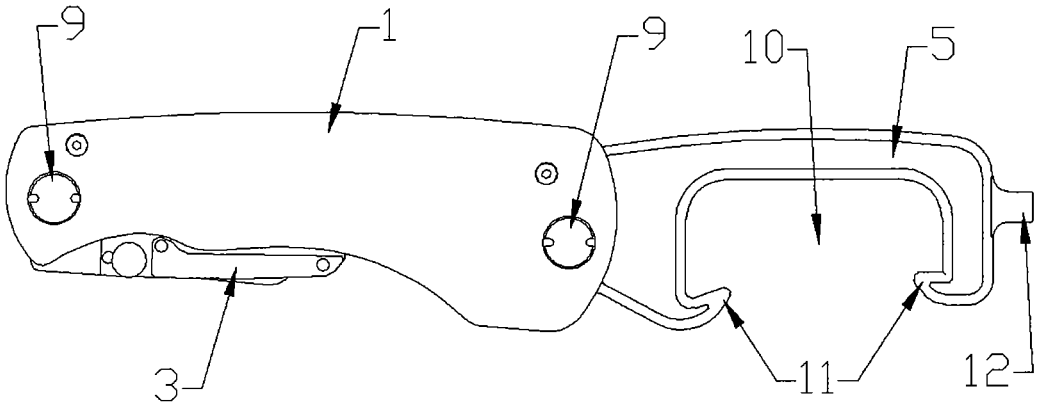
FIG. 3 is a schematic view of an embodiment according to the present invention showing the hand tool with the can opener unfolded, and the blade carrier and the putty knife folded.

As seen is FIGS. 1, 2 and 4, the spacer mentioned above has substantially the same shape as that of the sidewall of the handle, and when the tool is in its open position, that is to say, the elastic parts of spacers 15,16 are in their lock-fit positions, the side in the deflecting direction of the elastic part has at least a portion exposed out of the sidewall of the handle 1, so as to allow the user to laterally press the elastics part back and fold the tool easily.

Figure 9:
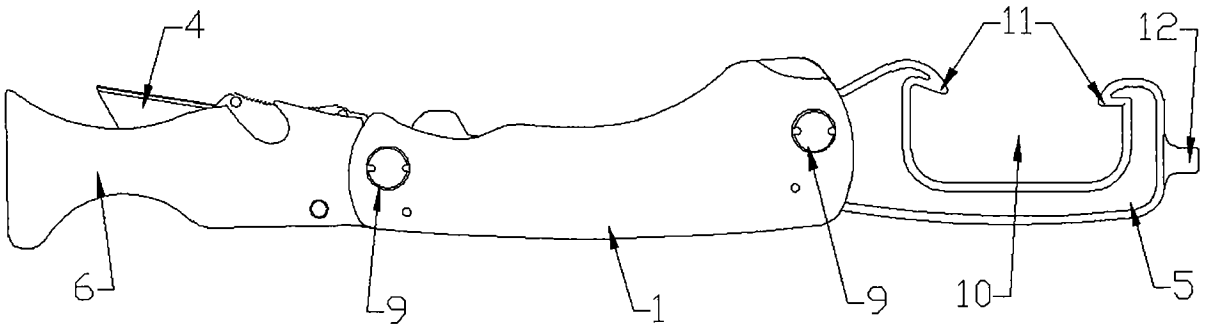
FIG. 9 is a top view of FIG. 8.

As shown in FIGS. 7 and 9, in this embodiment, the can opener 5 is at one end of the hand tool and the blade carrier 3 and the putty knife 6 are at the other end, while in other embodiments, the can opener 5 and the blade carrier 3 and/or the putty knife 6 can be arranged at the same end. That is to say, the blade carrier 3, the can opener 5 and the putty knife 6 can be pivotally connected to the same end assembled or to both ends individually, and can rotate to unfold from one edge of the handle 1 in the first or second pivoting direction. Correspondingly, the elastic piece can also be formed at one edge or both edges of one end or both ends of the spacer 15 or 16. In such embodiment, the cutting function of the blade, the can opening function of the can opener and the plastering function of the putty knife are collected in a single hand tool, which makes the tools safe, convenient to carry and reduce the possibility of missing and losing.

Preferred embodiments of the present invention have been described above. It should be understood that many modifications and variations can be made by ordinary technician of the field according to conception of present invention without creative labor. Therefore, all the technical schemes obtained through logical analysis, deductions or limited experimentation based on the present invention by technicians of the field are within the scope of the claims.

The invention claimed is:

1. A hand tool, comprising:

a handle with a containing chamber, and a can opener that is rotatably received in the containing chamber or unfolded connected pivotally to one end of the handle, wherein the can opener is made of metal material and used to open paint can lid;

a blade carrier which mounted a replaceable blade, which is rotatably received in the containing chamber or unfolded, is also pivotally connected to one end of the handle;

a putty knife that is rotatably received in the containing chamber or unfolded is also pivotally connected to one end of the handle; and an elastic part with lateral elastic force, the elastic part is disposed in the containing chamber of the handle, and at least one of the blade carrier, the can opener and the putty knife has a positioning part at the pivotally connected end thereof, the side of the elastic part engages against the side of the pivotally connected end by the lateral elastic force when bided, while the elastic part deflects and forms a lock-fit with the positioning part when unfolded;

wherein:

the can opener includes a front end and is defined by a plate-shaped member having first and second edges and a jaw in a middle thereof;

each edge of the jaw of the plate-shaped member includes a hook-shaped member extending towards an inside of the jaw; and a groove is arranged on the replaceable blade, and a locking member is arranged on the blade carrier; the locking member is arranged to rotate partially by stirring a pin arranged on the locking member about a positioning pin connected to the blade carrier, so as to be locked in the groove of the blade or to be held up to release the blade.

2. The hand tool according to claim 1 wherein the positioning part is a platform formed at the end of the pivoting end, and the lock-fit is formed by engaging the straight edge of the end part of the elastic part against the platform.

3. The hand tool according to claim 2, wherein the platform has an ascending slope at a deflecting direction of the elastic part, so as to make the deflected elastic part form a tight fit automatically with the platform.

4. The hand tool according to claim 1 wherein the elastic part is an elastic piece formed by slotting partially on a spacer fixed in the containing chamber.

5. The hand tool according to claim 4 wherein the elastic piece is formed at one or both edges of one or both ends of the spacer.

6. The hand tool according to claim 1 wherein the side of the elastic part, which contacts at least one of the blade carrier, the can opener and the putty knife, has a point-shaped protrusion, and the protrusion is as such arranged that when at least one of the blade carrier, the can opener and the putty knife is received in the containing chamber, the point-shaped protrusion slides into the corresponding groove arranged on the containing chamber.

7. The hand tool according to claim 1, wherein a through hole or a groove is arranged on the body of the putty knife.

* * * * *